US006776227B2

(12) United States Patent
Beida et al.

(10) Patent No.: US 6,776,227 B2
(45) Date of Patent: Aug. 17, 2004

(54) WELLHEAD HEATING APPARATUS AND METHOD

(76) Inventors: Rodney T. Beida, 4701 49th Street, Athabasca, Alberta (CA), T9S 1R1; Darcy R. Zelman, Box 824, Athabasca, Alberta (CA), T9S 2A7

( * ) Notice: Subject to any disclaimer, the term of this patent is extended or adjusted under 35 U.S.C. 154(b) by 0 days.

(21) Appl. No.: 10/306,228

(22) Filed: Nov. 29, 2002

(65) Prior Publication Data

US 2003/0168518 A1 Sep. 11, 2003

(51) Int. Cl.[7] ..... E21F 1/00

(52) U.S. Cl. ..... 166/61; 166/901; 166/57; 237/70

(58) Field of Search ..... 237/70, 71; 166/61, 166/57, 62, 901, 302

(56) References Cited

U.S. PATENT DOCUMENTS 2,911,047 A * 11/1959 Henderson ..... 166/61
3,062,289 A * 11/1962 Henry ..... 166/61
3,749,163 A * 7/1973 Waters ..... 166/57
4,641,710 A * 2/1987 Klinger ..... 166/400
5,049,724 A 9/1991 Anderson
6,009,940 A * 1/2000 Eck et al. ..... 166/60
6,032,732 A 3/2000 Yewell
6,260,615 B1 * 7/2001 Dalrymple et al. ..... 166/60
6,588,500 B2 * 7/2003 Lewis ..... 166/61

* cited by examiner

*Primary Examiner*—Derek Boles
(74) *Attorney, Agent, or Firm*—Miller & Thomson LLP

(57) ABSTRACT

Apparatus and method for heating and preventing freeze-off of wellhead equipment utilize radiant heat from a flameless heater to heat fluid in a heat exchanger, such as a tank or finned radiator. A pump is used to circulate the heated fluid through a conduit loop deployed in thermal contact with the equipment to be heated, such that the heat from the fluid is transferred to the equipment, maintaining it at sufficient temperature to prevent freeze-off. The apparatus and method may also be used for other purposes, such as for circulating heated fluid through a liquid-cooled engine to facilitate cold weather starting.

9 Claims, 4 Drawing Sheets

WELLHEAD HEATING APPARATUS AND METHOD

FIELD OF THE INVENTION

The present invention relates to apparatus and methods for preventing freezing of wellhead equipment associated with gas wells and oil wells. More particularly, the invention relates to such apparatus and methods that utilize heat from flameless heat sources such as infrared heaters.

BACKGROUND OF THE INVENTION

Freezing of wellhead equipment is a common risk for oil wells and gas wells in regions that experience extremely cold winters, such as Alaska and northern Canada. Natural gas contains hydrates, which may condense out of the gas and then solidify when temperatures are very low, particularly when the situation is aggravated by a drop in gas pressure. Unless sufficient heat is provided, or unless other means are provided for preventing condensation of hydrates, the wellhead equipment installed on a producing well to control and regulate flow of oil or gas, as the case may be, can "freeze off" and cease to function when temperatures fall below freezing (i.e., zero degrees Celsius). When this happens, valuable production is lost, and additional expense must be incurred to have skilled technicians attend at the well site to remedy the freeze-off and restore flow from the well.

The prior art discloses several approaches to the prevention of wellhead freezing, often involving the application of known heat tracing methods. Canadian Patent No. 1,299,620, issued to Anderson on Apr. 29, 1992 (similar to U.S. Pat. No. 5,049,724, issued to Anderson on Sep. 17, 1991), describes a flexible, insulated jacket adapted to fit closely around a specific piece of wellhead equipment. Heat is delivered to the wellhead equipment by means of electric heating cables disposed in a selected pattern within the jacket, and connected to an external electrical power source. Although the Anderson apparatus may function adequately to prevent freezing of the equipment, it has significant disadvantages. Firstly, it must be custom-fabricated to suit particular equipment, and thus is not readily adaptable for effective or efficient use with other equipment. Secondly, it requires an external electrical power source, which may be practically unfeasible or prohibitively expensive, particularly at remote well sites, where the only practicable way of providing electrical power source might be by use of a generator requiring a reliable supply of refined fuel such as diesel oil.

U.S. Pat. No. 6,032,732, issued to Yewell on Mar. 7, 2000, discloses a wellhead heating system that circulates heated coolant, from a liquid-cooled engine driving an oil well pumper, through insulated conduit arranged as desired in thermal contact with the wellhead equipment, such that heat from the circulating coolant is transferred to the equipment. The Yewell apparatus has a serious drawback, however, in that it is applicable only at well sites where a source of heated fluid is readily available, such as where a liquid-cooled engine has been provided for one reason or another.

Other approaches to the problem have included provision of heat tracing loops circulating hot water or steam from heaters or boilers, or direct injection of antifreeze fluids such as methanol. Once again, such approaches are excessively expensive if not entirely impractical for remote well sites, because of the cost and inconvenience of maintaining a reliable source of power or fuel for the heaters or boilers, or providing injection pumps and sufficient supplies of antifreeze fluids. In fact, well-operating companies may find it less costly overall to incur occasional production losses from wellhead freeze-off at remote well locations, plus the expense of sending technicians out to remedy freeze-off situations, than to provide means for keeping the remote wellheads warm, given the cost of providing heat sources (e.g., electric power, diesel generators, or propane heaters) or antifreeze injection equipment needed to prevent freeze-off.

It is commonly necessary to provide an enclosure in the general vicinity of a wellhead to house accessory equipment, such as meters or compressors, which must be maintained above particular temperatures in order to remain functional. These enclosures are often heated using flameless infrared catalytic heaters. Such heaters may be fuelled by propane, although that requires provision of a suitable source of propane at or near the well site. More conveniently and more economically, it is often feasible to fuel these heaters with natural gas diverted directly from the well. The gas may be purified if necessary or desired, using fuel gas scrubbers installed upstream of the heaters, in order to enhance the heaters' operational efficiency and reliability. By using natural gas directly from the well, these heaters are able to keep the accessory equipment warm without the need for additional sources of fuel or electrical power. Accordingly, infrared catalytic heaters fuelled by natural gas are particularly well suited for use at remote well sites where provision of other fuels or electrical power may be problematic.

Whether fuelled by natural gas or other fuels, however, such heaters are not always used as effectively or efficiently as possible. A heater in a given equipment enclosure will commonly generate more heat than needed to keep the equipment in the enclosure at the desired temperature. It is therefore desirable to make use of this excess heating capacity, which would otherwise be wasted or not optimally exploited.

For the foregoing reasons, there is a need in the oil and gas industry for improved apparatus and methods for preventing freezing of wellhead equipment associated with gas wells and oil wells. In particular, there is a need for such apparatus and methods that minimize or eliminate the need for antifreeze injection, or for supplementary power or fuel. There is a further need for such apparatus and methods that utilize heat from flameless heat sources such as infrared catalytic heaters. The present invention is directed to these needs.

BRIEF SUMMARY OF THE INVENTION

In general terms, the present invention provides an apparatus and method utilizing heat from a flameless heater to heat a fluid that may be circulated through a conduit loop, a portion of which is deployed sufficiently close to an object desired to be heated, such that the heat from the fluid is transferred to that object, thereby heating it. The conduit loop may also be referred to as a heat tracing loop, the phrase "heat tracing" being commonly used to refer to any method that deploys heating elements (which may include electrical heating cables or, as in the present case, conduit carrying a heated fluid) in close association with an object to be heated, such as a piece of equipment or a length of piping.

In the present invention, a heat exchanger filled with fluid is placed in close proximity to the heating element of a flameless heater, such as an infrared catalytic gas heater, such that heat from the heater is transferred to the fluid in the heat exchanger. The heat exchanger has a filler opening to be used for introducing a fluid into the fluid reservoir. It also has a fluid inlet and a fluid outlet, both of which are in fluid communication with the fluid reservoir. The conduit loop is connected at one end to the fluid inlet and at the other end to the fluid outlet, and loop may be considered as comprising two sections, namely a supply section originating at the fluid outlet, and a return section terminating at the fluid inlet. The supply section and the return section are essentially contiguous, the point of demarcation between them being the region where, in a given application, the fluid begins to flow back to the heat exchanger rather than outward therefrom. A pump, such as an electric or gas-actuated pump, is provided for circulating the heated fluid through the conduit loop.

Accordingly, in one aspect the present invention is a heating apparatus, for use in association with a flameless heater having a heat-radiating element, said apparatus comprising:

a heat exchanger having an interior reservoir, a filler opening, a fluid outlet, and a fluid inlet;

a conduit loop running from the fluid outlet to the fluid inlet, said conduit loop comprising a supply section originating at and connecting to the fluid outlet, and a return section terminating at and connecting to the fluid inlet; and a pump associated with the conduit loop;

wherein the heat exchanger is positioned sufficiently close to the heat-radiating element such that a fluid within the interior reservoir may be heated by radiant heat from the flameless heater.

In another aspect, the invention is a heating apparatus comprising:

a flameless heater having a heat-radiating element;

a heat exchanger having an interior reservoir, a filler opening, a fluid outlet, and a fluid inlet;

a conduit loop running from the fluid outlet to the fluid inlet, said conduit loop comprising a supply section originating at and connecting to the fluid outlet, and a return section terminating at and connecting to the fluid inlet; and a pump associated with the conduit loop;

wherein:

the heat exchanger is positioned sufficiently close to the heat-radiating element such that a fluid within the interior reservoir may be heated by radiant heat from the flameless heater; and the conduit loop is deployed in thermal contact with an object to be heated.

In a further aspect, the present invention is a method for heating a stationary object, said method comprising the steps of:

providing a flameless heater having a heat-radiating element;

providing a heat exchanger having an interior reservoir, a filler opening, a fluid outlet, and a fluid inlet;

providing a conduit loop running from the fluid outlet to the fluid inlet, said conduit loop comprising a supply section originating at and connecting to the fluid outlet, and a return section terminating at and connecting to the fluid inlet;

providing a pump associated with the conduit loop;

deploying the conduit loop in thermal contact with an object to be heated;

introducing a quantity of fluid into the interior reservoir of the heat exchanger through the filler opening;

positioning the heat exchanger sufficiently close to the heat-radiating element such that the fluid within the interior reservoir may be heated by radiant heat from the flameless heater;

activating the flameless heater; and activating the pump.

In a still further aspect, the invention is a method for heating a stationary liquid-cooled engine, said engine having an internal coolant chamber, a coolant inlet, and a coolant outlet, said method comprising the steps of:

providing a flameless heater having a heat-radiating element;

providing a heat exchanger having an interior reservoir, a filler opening, a fluid outlet, and a fluid inlet;

providing a conduit loop comprising a supply section running from the fluid outlet of the heat exchanger to the coolant inlet of the engine, and a return section running from the coolant outlet of the engine to the fluid inlet of the heat exchanger;

providing a pump connected into the conduit loop;

introducing a quantity of fluid into the interior reservoir of the heat exchanger through the filler opening;

positioning the heat exchanger sufficiently close to the heat-radiating element such that the fluid within the interior reservoir may be heated by radiant heat from the flameless heater;

activating the flameless heater; and activating the pump.

In the preferred embodiments of the invention, the flameless heater is an infrared catalytic heater fuelled by a gaseous fuel, preferably natural gas. In an alternative embodiment, a second flameless heater is provided, such that the heat exchanger may be "sandwiched" between the two heaters, thus providing additional input of heat to the fluid in the reservoir.

The heat exchanger may be a simple tank, but it will preferably be a finned radiator in the nature of an automotive radiator, having a fluid reservoir and a number of finned tubes in fluid communication with the fluid reservoir. The fluid used in the heat exchanger may be any fluid suitable for use in a fluid heat-exchanging system, such as water or ethylene glycol anti-freeze fluid. In the preferred embodiment, the apparatus includes a surge tank in fluid communication with the interior reservoir of the heat exchanger. The surge tank allows for expansion of the fluid as it is heated, thereby preventing the development of undesirable pressure build-up within the heat exchanger and the conduit loop.

In the preferred embodiment, a portion of the conduit loop is covered with thermal insulation to minimize loss of heat from the fluid therein, in order to maximize the heat available for transfer to the equipment or other object to be heated.

Where the pump is an electric pump, it may be powered by electricity from an external supply such as conventional electrical service, if available, or an electrical generator. The generator could be a diesel-fired generator, or it could be fuelled by propane or natural gas. In an alternative embodiment, the electric pump is powered by electricity from a storage battery. A solar panel may be provided for generating electricity for storage in the battery.

In the preferred embodiment, the heat exchanger is provided with brackets by use of which the heat exchanger may be conveniently mounted onto the flameless heater in a desirable configuration.

In one embodiment, a shroud is provided for enclosing the flameless heater and the heat exchanger to protect them from the elements in applications where the flameless heater is not situated inside an enclosure.

In a yet further aspect, the present invention is a gas supply system, for use in association with a heating system having a heating exchanger for heating a fluid, a gas-fired flameless heater for radiantly heating the fluid in the heat exchanger, and a gas-driven pump for circulating the fluid from the heat exchanger, said pump having a gas inlet port and a gas exhaust port; said gas supply system comprising:

- a primary gas line in fluid communication with the gas inlet port of the pump, for delivering pressurized gas from a main gas supply for driving the pump;
- a secondary gas line in fluid communication with the gas exhaust port of the pump, for carrying exhaust gas from the pump to the flameless heater;
- a back-up fuel gas supply line in fluid communication with the secondary gas line;
- a valve mounted in the back-up fuel gas supply line; and
- valve-actuating means, for opening or closing the valve.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENT

Figure 1:
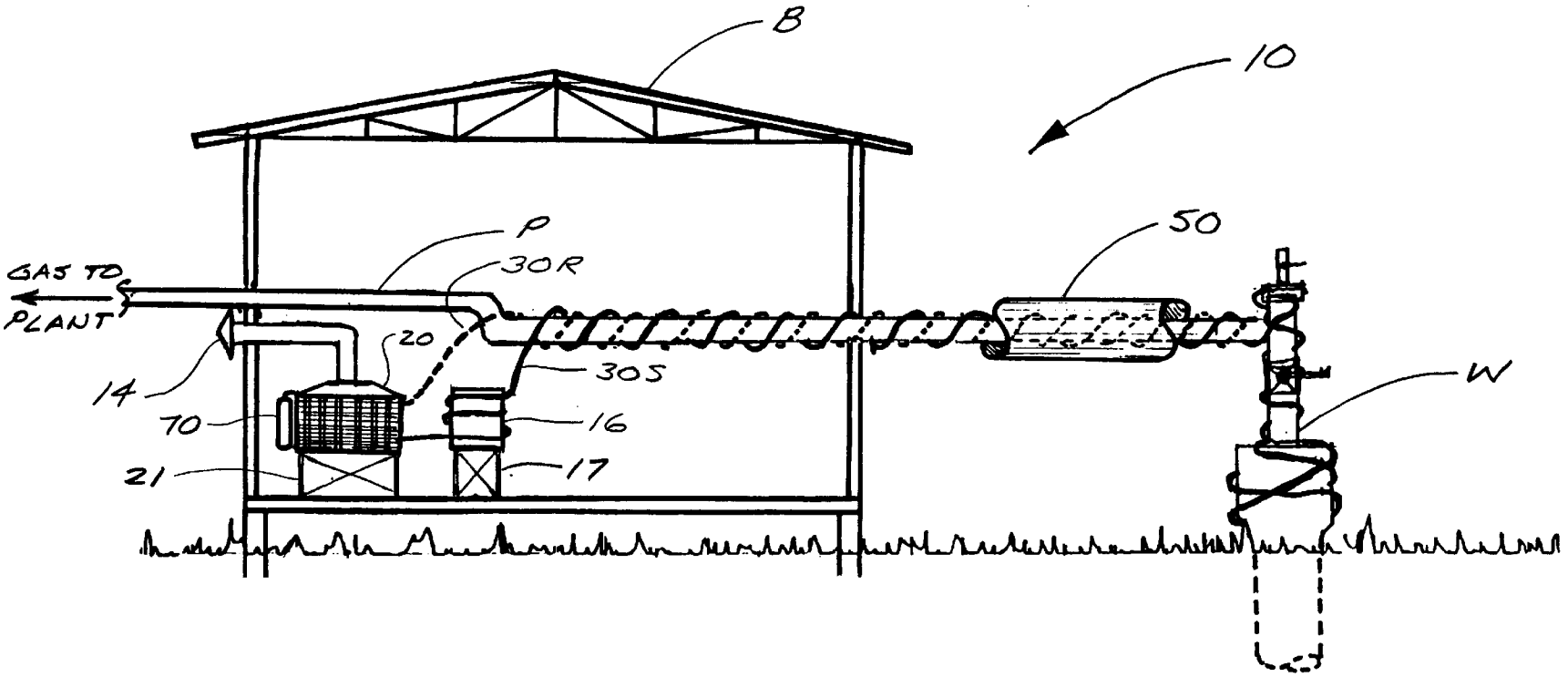
FIG. 1 is a schematic elevational view illustrating an embodiment of the invention in use in association with a wellhead.
Figure 2:
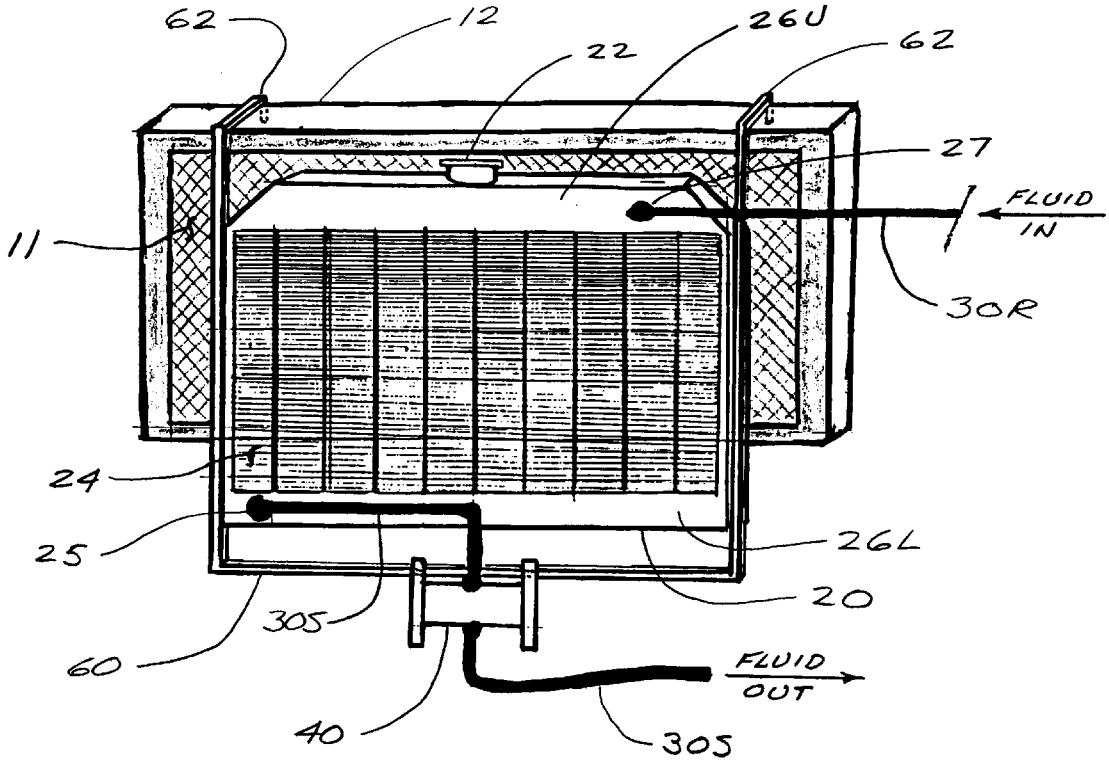
FIG. 2 is an isometric view of the heat exchanger and flameless heater of one embodiment of the invention.
Figure 3:
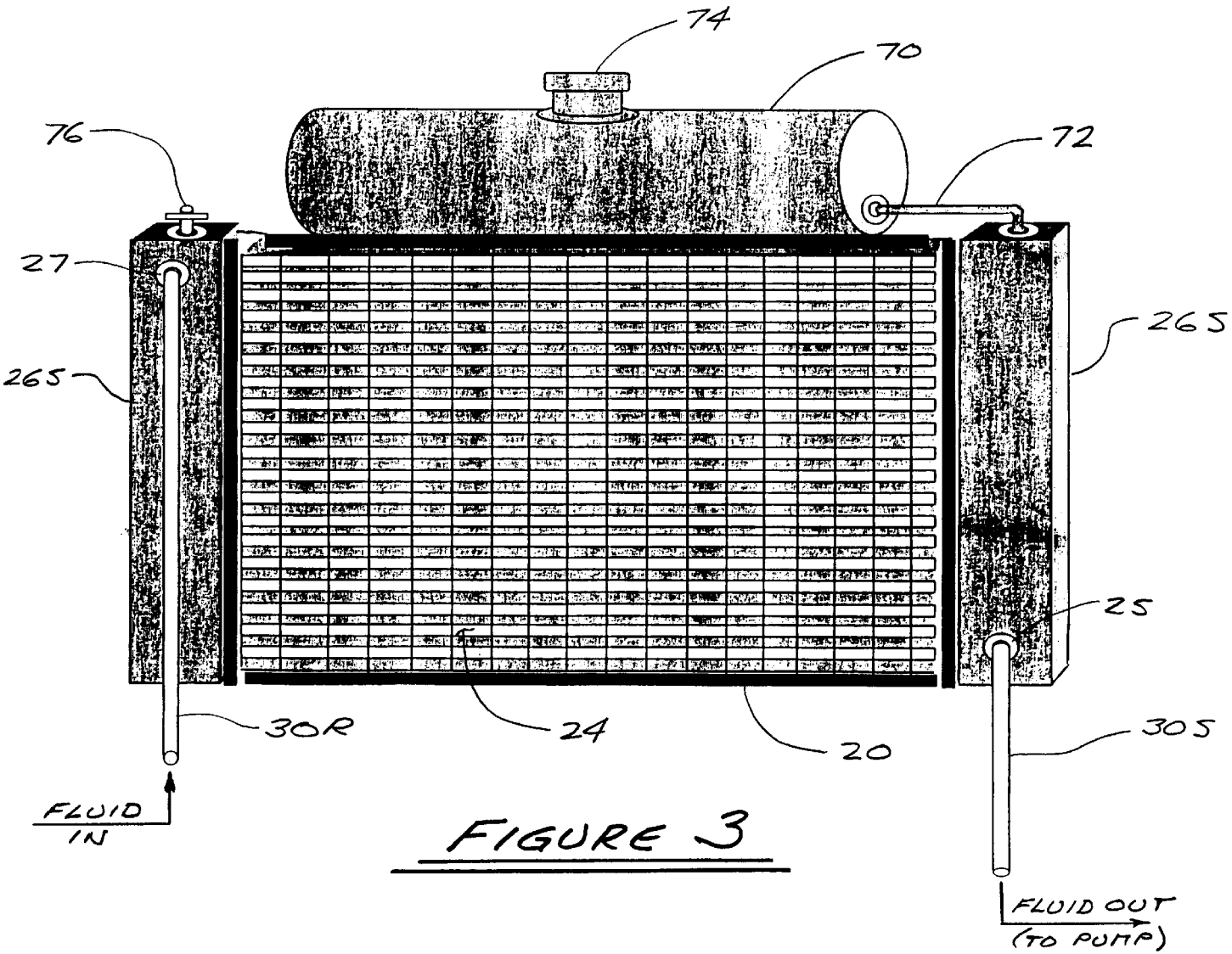
FIG. 3 is an isometric view illustrating an alternative embodiment of the invention.

Referring to FIGS. 1, 2, and 3, the apparatus of the present invention, generally represented by reference numeral 10, includes a heat exchanger 20 having an internal fluid reservoir and a filler cap 22 through which a fluid may be poured into the reservoir. The filler cap 22 may include a pressure relief valve (not shown) for dissipating vapour pressure that may build up within the reservoir. The heat exchanger 20 may be of any desired shape, and could be a simple tank. In the preferred embodiment, however, the heat exchanger 20 comprises a finned tube assembly 24, of a type generally similar to finned tube assemblies well-known in the field of automotive radiators, and two sub-reservoirs 26, the finned tube assembly 24 being disposed between the two sub-reservoirs 26. In the embodiment illustrated in FIG. 2, the sub-reservoirs 26 are positioned above and below the finned tube section 24; these sub-reservoirs may be conveniently referred to as upper sub-reservoir 26U and lower sub-reservoir 26L. In the embodiment illustrated in FIG. 3, the sub-reservoirs 26 are positioned at the sides of the finned tube section 24; these sub-reservoirs may be conveniently referred to as side sub-reservoir 26S. In each embodiment, the finned tube assembly 24 comprises a plurality of finned tubes in fluid communication with both sub-reservoirs 26U and 26L, or 26S, as the case may be. In these embodiments, the internal fluid reservoir of the heat exchanger 20 comprises the internal volumes of the sub-reservoirs 26 and the tubes of the finned tube assembly 24.

The heat exchanger 20 has a fluid outlet 25 and a fluid inlet 27, both of which are in fluid communication with the internal fluid reservoir of the heat exchanger 20. In the embodiment illustrated in FIG. 2, the fluid outlet 25 is shown located in lower sub-reservoir 26L, and the fluid inlet 27 is shown located in upper sub-reservoir 26U. However, this arrangement is not essential; the fluid outlet 25 could be located in upper sub-reservoir 26U and the fluid inlet could be located in lower sub-reservoir 26L without departing from the essential concept of the invention.

In the embodiment illustrated in FIG. 3, fluid outlet 25 is located in one side sub-reservoir 26S, and fluid inlet 27 is located in the other side sub-reservoir 26S. More specifically, FIG. 3 shows fluid outlet 25 located near the bottom of one side sub-reservoir 26S, and the fluid inlet 27 located near the top of one side sub-reservoir 26S. Once again, however, this arrangement is not essential; the fluid outlet 25 could be located near the top of its corresponding side sub-reservoir 26S and the fluid inlet 27 could be located near the bottom of its corresponding sub-reservoir 26S without departing from the essential concept of the invention. In fact, it may be advantageous to have the fluid outlet 25 positioned near the top of the heat exchanger 20 to prevent or minimize loss of fluid from the system in the event of a leak in the conduit loop 30.

The invention 10 also includes a conduit loop 30. In the preferred embodiment, the conduit loop 30 is fashioned from flexible plastic tubing. However, rigid or semi-rigid tubing, such as tubing made from steel, copper, or other metallic materials, may also be used for the conduit loop 30. The conduit loop 30 is effectively continuous, but may be considered as having two main sections, namely a supply section 30S connected to the fluid outlet 25 of the heat exchanger 20, and a return section 30R (indicated by broken lines in FIG. 1, for clarity) connected to the fluid inlet 27. Also provided is a pump 40 for circulating fluid from the heat exchanger 20 through supply section 30S of conduit loop 30 and back to the heat exchanger 20 through return section 30R. The pump 40 may be installed at a convenient point in supply section 30S of conduit loop 30, preferably in reasonably close proximity to the heat exchanger 20, as illustrated in FIG. 2.

The pump 40 may be driven by an electric motor, having as its primary source of electric power a generator or other electricity service that may be available at the site where the invention 10 is installed. Alternatively, solar panels may be provided to as the primary source of power for the electric motor, thus eliminating the need to provide a generator or conventional electrical service. In this alternative embodiment, a battery will be provided for storage of electricity generated by the solar panels. A battery may also be provided as a source of back-up power for the electric motor in the event of disruption of power from the primary power supply.

Figure 4:
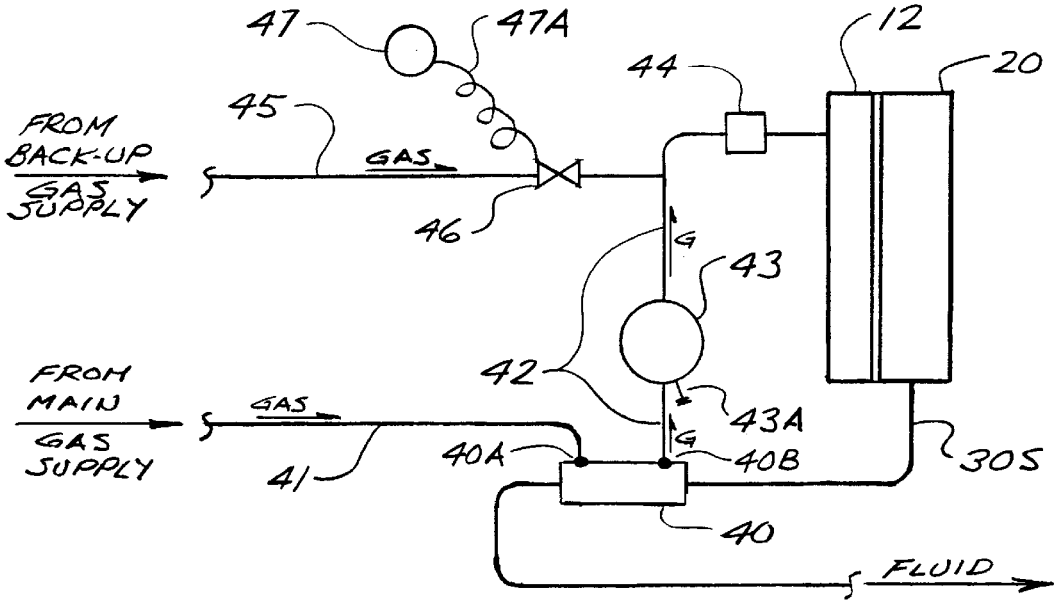
FIG. 4 is a schematic diagram of a gas supply system for one embodiment of the invention incorporating a pump actuated by pressurized gas.

In another embodiment, the pump 40 is of a type driven by pressurized gas, such as natural gas or propane, thus allowing the invention 10 to be used in locations where electric power is not conveniently available. In this embodiment, the pump 40 will have a gas inlet port 40A and a gas exhaust port 40B, as shown in FIG. 4. Gas to actuate the pump 40 may be supplied from a different source than the gas that fuels the flameless heater 12. For example, the pump 40 could be actuated by propane from a propane storage tank, while the flameless heater 12 is fuelled by natural gas, or vice versa, with independent gas supply lines running from the two gas sources to the pump 40 and to the flameless heater 12.

However, the gas for these two purposes may be a combustible gas supplied from a common source, and in that case there may be independent gas supply lines from the gas source to the pump 40 and to the flameless heater 12. Alternatively, there may be a primary gas supply line 41 that runs to the gas inlet port 40A of pump 40, plus a secondary gas line 42 that carries the gas exhausted from the gas exhaust port 40B of the pump 40 to the flameless heater 12, as illustrated in FIG. 4. Preferably, the secondary gas line 42 will run into a receiver tank 43 and thence through a pressure regulator 44, for controlling the flow of fuel gas to the flameless heater 12. The receiver tank 43 preferably will have a pressure relief valve 43A for preventing excess pressure build-up in the secondary gas line 42, and for draining any water that might condense out of the gas exhausted from the pump 40.

This gas supply system provides both environmental and economic benefits. Whereas gas-driven pumps commonly exhaust the actuating gas to the atmosphere, this form of pollution is eliminated or minimized in the system described above. Furthermore, because the gas serves two functions, the total amount of gas needed to drive the pump 40 and to fuel the flameless heater 12 is reduced, thereby reducing operational costs.

One potential problem with this system, however, is that if the pump 40 malfunctions for any reason, stopping the flow of exhaust gas into secondary gas line 42, the flow of fuel gas to the flameless heater 12 will stop, and the flameless heater 12 will cease functioning. This may result in a significant temperature drop within the enclosure where the heater is located, possibly causing malfunction of instruments or other equipment installed inside the enclosure, before repair personnel are able to detect and repair the problem. This would be of particular concern at isolated installations, because of the time it might take for repair personnel to travel to the site after the problem has been diagnosed.

To minimize such risks in the event of a pump failure, the preferred embodiment of the present invention will include a back-up fuel gas supply line 45 connected into the secondary gas line 42, as shown in FIG. 4. The gas flowing in the back-up fuel gas supply line 45 may come from the same source as the gas flowing to the pump 40 through the primary gas supply line 41, or it could come from a different source (and could be a different type of gas). A valve 46 is installed in the back-up fuel gas supply line 45, and this valve 46 will typically be closed so long as gas is flowing normally to the flameless heater 12 through the secondary gas line 42. Instrumentation of various well-known types may be used to open the valve 46 in the event that gas has ceased flowing to the flameless heater 12 through the secondary gas line 42. For example, a controller (not shown) could be provided for opening the valve 46 immediately upon detection of reduced or interrupted flow of gas through the secondary gas line 42. In the particular embodiment shown in FIG. 4, the valve 46 is controlled by a thermostat 47 (shown with control wiring 47A), monitors ambient air temperature inside the enclosure housing the flameless heater 12. The thermostat 47 may be set to open the valve 46 whenever the ambient temperature drops below a selected value, indicating that the flameless heater 12 has stopped operating for lack of fuel gas supply. Fuel gas will then begin flowing to the flameless heater 12 from the back-up fuel gas supply line 45.

The operation of the present invention may be best understood with reference to FIGS. 1, 2, and 3. FIG. 1 schematically illustrates a utility building B which has been provided to enclose equipment (such as meters) required in connection with operation of a producing natural gas well. The well has an assembly of equipment collectively referred to as a wellhead, generally represented by reference character W in FIG. 1. A pipeline P carries natural gas from the wellhead W to a gas-processing plant (not shown), passing through the utility building B wherein secondary piping (not shown) diverts natural gas to meters or other equipment (not shown). A flameless heater 12, having a heat-radiating surface 11 (as best seen in FIG. 2) and a vent 14 (for discharging products of combustion), is installed inside the utility building B to keep the meters or other equipment warm enough to function properly during cold conditions. The flameless heater 12 is not clearly visible in FIG. 1, as it is obscured in that view by the heat exchanger 20. The flameless heater 12 may be existing at the facility in which the invention 10 is to be installed. In an alternative embodiment, the flameless heater 12 forms one component of the invention.

The flameless heater 12 may be fuelled by propane supplied from a tank, or may be fuelled by natural gas supplied directly from the well. In the latter case, it will commonly be necessary or desirable, in order to ensure optimal performance of the flameless heater 12, to process the gas through a fuel gas scrubber 16 to remove impurities such as moisture from the gas before it is delivered to the heater 12. In FIG. 1, the scrubber 16 is shown supported by a stand 17, but it might also be suspended from the structure of the utility building B or supported in some other conventional way. In any event, the scrubber 16 does not form part of the present invention, and is described and illustrated solely to promote a fuller understanding of the types of installations in which the invention may be applied.

In accordance with the present invention, the heat exchanger 20 is installed in close proximity to the heat-radiating element 11 of the flameless heater 12, such that heat generated by the heater 12 radiates to the heat exchanger 20, thus heating the fluid inside the heat exchanger 20. The conduit loop 30 is deployed, in whatever fashion may be convenient, so as to extend out to the wellhead W (or other equipment desired to be heated). In typical installations, this will involve running the supply section 30S along the pipeline P out to the wellhead W, preferably coiling the supply section 30S around the pipeline P as shown in FIG. 1, in order to warm the pipeline P as well. The conduit loop 30 is then arranged around the wellhead W as generally illustrated in FIG. 1, such that portions of the conduit loop 30 are in contact with the wellhead W or otherwise in sufficiently close proximity to the wellhead W that heat from fluid circulating through the conduit loop 30 may be transferred to the wellhead W, thereby keeping the wellhead W warm enough to prevent freeze-off. If desired, in installations where a fuel gas scrubber 16 is used in conjunction with the flameless heater 12, the supply section 30S of conduit loop 30 may be wrapped around the scrubber 16 as illustrated in FIG. 1.

In the preferred embodiment of the invention, the wellhead, pipeline, or other equipment components that have thus been "traced" with conduit loop 30 will be partially or totally covered with thermal insulation 50, as conceptually illustrated in FIG. 1, to minimize heat loss from the fluid circulating through conduit loop 30, thereby maximizing the amount of heat available for transfer to the wellhead W and other traced components. Typically, it will be desirable to insulate traced components that are not protected from the elements by an enclosure such as the utility building B shown in FIG. 1. However, it may also be desirable to insulate traced components within such an enclosure, even when the enclosure is heated, in order to maximize the operational efficiency of the invention.

In some situations there may not be an enclosure near the wellhead W; e.g., at remote wellhead locations. In such cases, an alternative embodiment of the invention 10 may be used wherein a shroud (not shown) is also provided. The shroud is made of suitable size and configuration to enclose the flameless heater 12 and the heat exchanger 20 when arranged in accordance with the invention, thus protecting the flameless heater 12 and the heat exchanger 20 from direct contact with the elements such as wind, rain, and snow. The shroud may be made of metal or wood or any other convenient material, and in the preferred embodiment will be lined with insulation. The shroud will be fabricated with openings as may be required for components such as the vent 14 of the flameless heater 12, a fuel gas supply line for the heater 12, and the supply section 30S and return section 30R of conduit loop 30. The shroud may also have one or more hatches or other types of openings for convenient access to the components for service and maintenance purposes.

In the preferred embodiment, the flameless heater 12 is an infrared catalytic heater fuelled by propane or natural gas; for example, a CATA-DYNE® heater manufactured by CCI Thermal Technologies Inc. of Edmonton, Alberta and Greensburg, Ind. An alternative embodiment of the invention (not illustrated in the Figures) comprises two flameless heaters 12 arranged on either side of the heat exchanger 20, thus increasing the amount of heat available for transfer to the fluid in the heat exchanger 20, and increasing the amount of heat available for transfer from the fluid to the wellhead W or other equipment being heated using the invention.

The heat exchanger 20 may be supported in any convenient fashion to maintain sufficiently close proximity to the flameless heater 12 for effective operation. For example, the heat exchanger could be supported on a stand 21 as conceptually illustrated in FIG. 1, or it could be suspended from an enclosing structure such as utility building B. In the preferred embodiment, as generally illustrated in FIG. 2, the heat exchanger 20 has a mounting frame 60 with brackets 62 adapted to fit over the flameless heater 12 such that the heat exchanger 20 is supported by the heater 12. The mounting frame 60 is particularly useful when the invention 10 is being retrofitted to an existing facility already having a flameless heater 12, but it may also be effectively used in embodiments where a flameless heater 12 is being provided as a component of the present invention. As schematically indicated in FIG. 2, the mounting frame 60 may also be adapted to support the pump 40.

As best illustrated in FIG. 3, the preferred embodiment of the invention includes a surge tank 70 in fluid communication with the fluid reservoir of the heat exchanger 20 by means of piping 72. The surge tank 70 may be positioned laterally adjacent to the heat exchanger 20, as shown in FIG. 1, but it will preferably be positioned above the heat exchanger 20 as in FIG. 3. The surge tank 70 preferably will include a pressure relief valve (not shown) of a type well known in the field of automotive radiators and other fields, such that any vapour pressure building up within the heat exchanger 20 and the surge tank 70 will be automatically dissipated through the pressure relief valve. In the embodiment shown in FIG. 3, the surge tank 70 has a filler cap 74 that may effectively function as the filler cap 22 of the heat exchanger 20. In the preferred embodiment, an air-bleed valve 76 is provided in association with the heat exchanger 20, as shown in FIG. 3, to facilitate removal of air in the fluid in the heat exchanger 20 or the conduit loop 30.

The invention may also be fitted with a low-level shutdown valve, of a type well known in the field of the invention. In the event that the fluid in the reservoir of the heat exchanger 20 drops below a pre-set level (e.g., because of a leak in the system), the low-level shutdown valve will shut off the pump 40 or, alternatively, shut off the supply of fuel gas to the flameless heater 12, thereby preventing overheating of the fluid. The low-level shutdown valve may be installed in association with an alarm mechanism to alert well operations personnel of the low-level condition so that steps may be taken to remedy the situation as promptly as possible.

The present invention may be used beneficially in various applications other than for heating wellhead equipment. For example, the invention may be used for heat tracing of instruments such as flow meters, either inside or outside an enclosure. The invention may also be used to keep liquid-cooled engines (e.g., stationary diesel engines driving electrical generators) warm to make starting easier in cold weather, in much the same fashion as electric block heaters are commonly used to heat liquid-cooled engines for passenger vehicles. A typical liquid-cooled engines have an internal coolant chamber plus a coolant inlet and a coolant outlet in fluid communication with the coolant chamber. In one embodiment of the present invention for warming such an engine, the supply section 30S and return section 30R of conduit loop 30 are separate, the supply section 30S is installed between the fluid outlet of the heat exchanger 20 and the coolant inlet of the engine, and the return section 30R is installed between the coolant outlet of the engine and the fluid inlet of the heat exchanger 20. The pump 40 is installed as conveniently desired in association with the conduit loop 30 (preferably in the supply section 30S). The engine coolant (typically containing ethylene glycol) is heated by circulation through the heat exchanger 20 of the invention, and may then be circulated by the pump 40 through the coolant chamber, thus warming the engine block. Various other beneficial uses of the invention will be readily apparent to persons skilled in the art.

The foregoing description of a preferred embodiment of the invention is given here by way of example only, and the invention is not to be taken as limited to or by any of the specific features described. It will be readily seen by those skilled in the art that various modifications of the present invention may be devised without departing from the essential concept of the invention, and all such modifications are intended to be included in the scope of the claims appended hereto.

The embodiments of the invention in which an exclusive property or privilege is claimed are defined as follows:

1. Heating apparatus, for use in association with a flameless heater having a heat-radiating element, said apparatus comprising:

(a) a heat exchanger having an interior reservoir, a filler opening, a fluid outlet, and a fluid inlet;

(b) a conduit loop running from the fluid outlet to the fluid inlet, said conduit loop comprising a supply section originating at and connecting to the fluid outlet, and a return section terminating at and connecting to the fluid inlet; and (c) a pump associated with the conduit loop;

wherein the heat exchanger is positioned sufficiently close to the heat-radiating element such that a fluid within the interior reservoir may be heated by radiant heat from the flameless heater, wherein the flameless heater is an infrared catalytic heater.

2. Heating apparatus comprising:

(a) a flameless heater having a heat-radiating element;

(b) a heat exchanger having an interior reservoir, a filler opening, a fluid outlet, and a fluid inlet;

(c) a conduit loop running from the fluid outlet to the fluid inlet, said conduit loop comprising a supply section originating at and connecting to the fluid outlet, and a return section terminating at and connecting to the fluid inlet; and (d) a pump associated with the conduit loop;

wherein:

(e) the heat exchanger is positioned sufficiently close to the heat-radiating element such that a fluid within the interior reservoir may be heated by radiant heat from the flameless heater; and (f) the conduit loop is deployed in thermal contact with an object to be heated, wherein the flameless heater is an infrared catalytic heater.

3. The apparatus of claim 1, wherein the flameless heater is fuelled by a gaseous fuel.

4. The apparatus of claim 1, wherein the heat exchanger comprises a tank.

5. The apparatus of claim 1, wherein the heat exchanger comprises a finned tube section.

6. The apparatus of claim 1, wherein the pump is an electric pump.

7. The apparatus of claim 6, further comprising a battery for supplying electric power to the electric pump, plus a solar panel for supplying electric power to the battery.

8. The apparatus of claim 1, wherein the pump is driven by a pressurized gas.

9. The apparatus of claim 1, further comprising one or more brackets mounted to the heat exchanger, said brackets being adapted for engaging the flameless heater and supporting the heat exchanger therefrom.

* * * * *